US005194129A

United States Patent [19]

Kerkar et al.

[11] Patent Number: 5,194,129

[45] Date of Patent: Mar. 16, 1993

[54] MANUFACTURE OF OPTICAL FERRULES BY ELECTROPHORETIC DEPOSITION

[75] Inventors: Awdhoot V. Kerkar, Columbia, Md.; Roy W. Rice, Alexandria, Va.; Robert M. Spotnitz, Baltimore, Md.

[73] Assignee: W. R. Grace & Co.-Conn., New York, N.Y.

[21] Appl. No.: 643,888

[22] Filed: Jan. 18, 1991

[51] Int. Cl.[5] ..... C25D 13/02

[52] U.S. Cl. ..... 204/181.5; 204/180.9

[58] Field of Search ..... 204/181.5, 180.9

[56] References Cited

U.S. PATENT DOCUMENTS

| | | | |
|---|---|---|---|
| 1,907,984 | 5/1933 | Kroner | 204/181.5 |
| 3,841,986 | 10/1974 | Rion et al. | 204/181.5 |
| 3,850,733 | 11/1974 | Szabo | 204/181.5 |
| 4,073,711 | 2/1978 | Powers | 204/181 |
| 4,092,231 | 5/1978 | Chronberg | 204/181 F |
| 4,351,709 | 9/1982 | Goetz | 204/183.3 |
| 4,357,222 | 11/1982 | Lucek | 204/181 F |
| 4,466,871 | 8/1984 | Kaup et al. | 204/181 N |
| 4,584,074 | 4/1986 | Sterling et al. | 204/181.1 |
| 4,719,026 | 1/1988 | Sher et al. | 252/62.54 |
| 5,019,537 | 5/1991 | Kato et al. | 501/1 |
| 5,021,376 | 6/1991 | Nienburg et al. | 501/153 |

FOREIGN PATENT DOCUMENTS

| | | | |
|---|---|---|---|
| 8081955 | 5/1983 | Japan | 204/181.1 |

OTHER PUBLICATIONS

"Electrophoretic Deposition of Alumina from Aqueous Suspensions" by J. Y. Choudhary, H. S.Ray and K. N. Rai, *Trans. J. Br. Ceram.* Soc. 81, pp. 189-193 (1982).

"Manufacture of Beta Alumina Shapes by Electrophoretic Deposition" by S. N. Heavens, *Brit. Ceram. Proc.*, No. 38, Davidge, R. W. ed., pp. 119-126 (1986).

"Electrophoretic Deposition of Coatings from Glass--Isopropanol Slurries" by Alan Sussman and Thomas J. Ward, *RCA Review*, vol. 42, 178 (1981).

Computer Printout or Powers Reference Cited by applicant in the second office action.

*Primary Examiner*—John Niebling
*Assistant Examiner*—Kishor Mayekar
*Attorney, Agent, or Firm*—Steven Capella

[57] ABSTRACT

The invention encompasses a method of forming a densified ceramic part comprising the steps:

a) forming an aqueous colloidal suspension of ceramic particles wherein the particles have a net positive surface charge;

b) placing electrodes in the suspension, at least one of the electrodes being a cathode adapted to receive a deposit of the ceramic particles, the cathode being further adapted to absorb any electrolysis products evolving at its surface;

c) placing a voltage across the electrodes whereby at least some of the ceramic particles are deposited on the cathode thereby coating the cathode;

d) removing the deposited coating from the cathode as a unitary piece from the cathode; and e) heating the piece to form a densified ceramic part.

18 Claims, No Drawings

MANUFACTURE OF OPTICAL FERRULES BY ELECTROPHORETIC DEPOSITION

FIELD OF THE INVENTION

This invention relates to the production of ceramic optical ferrules using electrophoresis.

BACKGROUND OF THE INVENTION

Optical ferrules are used in connecting the ends of optical fibers. The ferrule has the shape of a tiny tube with a canonical entry into which the fiber end is inserted as a means of providing optical connection between fibers. In this way, vast lengths of fibers can be connected with a minimum of degradation at the points of connection.

Their small size, about ½ inch long and about 1/16 inch in diameter, and requirement of high precision make current ceramic optical ferrules fairly expensive. Ceramic optical ferrules are usually made by injection molding or extruding alumina or other suitable ceramic material. These methods are very expensive, but they have been necessary to produce the ferrules which must have a very precise inner diameter.

Electrophoresis is a process whereby particles in a liquid suspension are drawn toward an electrode when an electric field is applied across the suspension. The direction and rate that a particle travels depends on the charge present on the particle's surface, the conditions of the medium in which the particle is suspended, conditions at the electrode(s), the electrical potential applied and the characteristics of the particle itself.

Often, the surface charge on a particle can be varied by changes in the pH, the concentration of electrolyte in the medium or by addition of a polyelectrolyte adapted to interact with the particle surface.

In the past, electrophoresis has been used to produce alumina coatings on stainless steel plates by Choudhary et al., *Trans. J. Br. Ceram. Soc.* 81, pp. 189–193 (1982). Choudhary et al. employed an aqueous suspension containing the alumina particles.

Electrophoresis has also been used to deposit enamel coatings from various suspensions onto workpieces. An example of enamel deposition is disclosed in U.S. Pat. No. 4,466,871 to Kaup et al.

Some have used electrophoresis to produce three-dimensional ceramic shapes such as described by Heavens in the article "Manufacture of Beta Alumina Shapes by Electrophoretic Deposition," *Brit. Ceram. Proc., No.* 38, Davidge, R. W. ed., pp. 119–126 (1986). Most of the three-dimensional shapes formed have been deposited on relatively large diameter electrodes (e.g., greater than 1 inch wide). Most of these prior art processes have involved the use of organic suspension media as opposed to aqueous media. Aqueous systems can have problems caused by hydrogen evolution at the cathode or oxygen evolution at the anode due to electrolysis of water.

There remains a need for an inexpensive process for reliably producing ceramic parts having very small inner diameters in proportion to the part thickness and close dimensional tolerances.

SUMMARY OF THE INVENTION

The present invention represents an adaptation of electrophoresis to produce ceramic parts having very small inner diameter from aqueous suspensions containing ceramic particles. More particularly, the invention provides an inexpensive method for producing ceramic optical ferrules using electrophoresis. The method of the invention advantageously avoids the problems associated with evolution of electrolysis gases at the deposit electrode.

The invention encompasses a method of forming a densified ceramic part comprising the steps:

a) forming an aqueous colloidal suspension of ceramic particles wherein the particles have a net positive surface charge;

b) placing electrodes in the suspension, at least one of the electrodes being a cathode adapted to receive a deposit of the ceramic particles, the cathode being further adapted to absorb any electrolysis products evolving at its surface;

c) placing a voltage across the electrodes whereby at least some of the ceramic particles are deposited on the cathode thereby coating the cathode;

d) removing the deposited coating from the cathode as a unitary piece from the cathode; and e) heating the piece to form a densified ceramic part.

In further aspects, the invention encompasses using suspension pH's below 7, more preferably about 1.5–2.0, and deposition voltages of about 2–1500 volts, more preferably about 25–200 volts, still more preferably about 50–150 volts. The cathode preferably contains palladium, palladium alloy and/or other hydrogen-absorbing material. The densified part preferably has a density equal to at least 95% of its theoretical density. Preferably, the densification is done by pressureless sintering.

DETAILED DESCRIPTION OF THE INVENTION

The process of the invention comprises two basic parts, namely the deposition of the ceramic by electrophoresis and the treatment of the deposited ceramic after removal from the electrode.

To perform the deposition, an aqueous suspension of the ceramic particles is first prepared. The suspension contains water and the particles to be deposited. A pH adjustment agent and/or other additives may be added to the suspension to alter the surface charge of the particles or characteristics of the aqueous medium. A binder can also be added.

The ceramic particles used may be any which exhibit suitable deposition characteristics. Alumina, zirconia, titania, zirconium aluminum titanate, and zirconia-toughened alumina are among the ceramic materials suitable for deposition on a cathode. Ceramic sintering aid particles such as $Y_2O_3$, $CaCO_3$ or $Cr_2O_3$ may also be deposited in combination with the other ceramic particles to facilitate subsequent densification. For producing optical ferrules, the particles should be small enough to produce a uniform deposit on a thin wire cathode. The particle size is preferably about 0.10–0.50 microns. Larger particles up to about 3–4 microns can be deposited if desired.

The water used is preferably deionized water. The pH adjustment agent can be any water-miscible organic or inorganic acid. The preferred pH adjustment agent is HCl. The binder may be any water soluble binder; a preferred binder is sold by Rohm & Haas under the name Rhoplex B 60-A.

The amount of water present in the suspension is preferably about 30 to 60 wt. % based on the total suspension. The amount of pH adjusting agent used is preferably the amount necessary to achieve a pH of about 1.5–2.0 (typically about 14 wt. % based on the amount of water present for 1N-HCl). The amount of binder used is preferably about 2.0 wt. % based on the weight of ceramic particles present.

Once the ingredients have been combined to form the suspension, the suspension is then placed in a container into which a plurality of electrodes including at least one cathode and one anode are inserted. A D.C. voltage is then applied across the electrodes whereby the ceramic particles deposit on the cathode(s).

The cathode contains a material (a hydrogen getter) adapted to absorb hydrogen evolving due to electrolysis at the cathode surface caused by the voltage applied across the electrodes. Preferred hydrogen getters are palladium or palladium alloys. A preferred cathode for forming optical ferrules is palladium wire. The cathode used for deposition may have a diameter as low as 100 μm (typically about 125 μm–150 μm).

While the invention is not limited to any particular electrode configuration, it is generally preferred that the deposition cathode(s) be surrounded uniformly by anodes. An example of such a configuration would be a vertical wire cathode surrounded by a cylindrical anode with the suspension located between the cathode and anode.

The voltage applied across the electrodes is preferably about 25–200 volts. The deposition time will vary according to factors such as the applied voltage, the desired thickness of the deposit, the ceramic being deposited, and the pH of the solution. Typical deposition times range from a few seconds to a few minutes.

The density of the deposit is preferably at least about 50% of the ceramic's theoretical density, more preferably at least about 60% of theoretical density. The density of the deposit may vary with the deposition conditions such as the voltage, the suspension composition and the like. The deposit thickness for optical ferrule production is preferably about 2500 μm thickness.

When the desired deposit has been achieved, the palladium electrode is removed from the suspension and the deposit is preferably allowed to dry briefly. The deposit is then removed from the palladium wire electrode as a unitary piece (i.e., a tube). The piece is then sintered to achieve a dense ceramic part.

The sintering method employed may be any suitable known method. For alumina ferrules, pressureless sintering is generally preferred since it is relatively inexpensive and results in acceptable high density products. For starting alumina particle size in the preferred range, sintering in air at about 1550° C. for about two hours produces a 97% of theoretical density alumina ferrule when starting with a 60% dense deposit.

The part may be machined and/or polished after sintering. Machining could theoretically be performed prior to sintering, however there would be a high risk of fracture due to the comparatively low strength of the unfired deposit.

While the invention has been discussed primarily with respect to optical ferrules, it should be understood that the method of the invention could be used to produce other ceramic parts such as thermocouple separators and the like. Such parts may include tubes having multiple hollow portions.

The following example is presented to illustrate an embodiment of the invention. The invention is not limited to any of the details recited in the example.

Example

A colloidal suspension was prepared by dispersing 60 grams of A-16 Alumina powder (manufactured by ALCOA, average particle size=0.42 μm) in 35 grams of deionized water. 5 grams of 1N-HCl was also added. The suspension was sonicated for about 5–6 minutes using an ultrasonic horn. 1.2 grams of Rhoplex binder was added and the suspension was stirred for about 15 minutes.

The suspension was transferred to an electrophoretic cell containing an anode and a palladium wire cathode. The anode was in the form of a cylinder surrounding the cathode with the suspension being located in between the anode and cathode. A voltage of about 25–200 volts was applied across the electrodes causing deposition to occur. The deposition was allowed to proceed for about 60 seconds resulting in a deposit having a thickness of about 2500 μm on the palladium wire.

The palladium wire electrode was removed from the suspension and the deposit was allowed to dry for about three minutes. The deposit was then removed from the wire as a unitary piece. The deposit density was about 50% of theoretical.

The piece was then fired in air at 1550° C. for about 2 hours to yield a 97% dense alumina ferrule.

What is claimed is:

1. A method of forming a densified ceramic part comprising the steps:

a) forming an aqueous colloidal suspension of ceramic particles wherein the particles have a net positive surface charge;

b) placing electrodes in said suspension, at least one of said electrodes being a cathode adapted to receive a deposit of said ceramic particles, said cathode being further adapted to absorb any electrolysis products evolving at its surface; wherein said cathode is a wire containing palladium;

c) placing a D.C. voltage across said electrodes whereby at least some of said ceramic particles are deposited on said cathode thereby coating said cathode;

d) removing said deposited coating from said cathode as a unitary piece; and e) sintering said piece to form a densified ceramic part.

2. The method of claim 1 wherein said colloidal suspension comprises ceramic particles and deionized water.

3. The method of claim 2 wherein said suspension further comprises a binder material.

4. The method of claim 3 wherein said suspension further comprises a pH adjustment additive.

5. The method of claim 3 wherein said additive is HCl.

6. The method of claim 1 wherein the pH of said suspension is maintained below about 7.0 during said deposition.

7. The method of claim 1 wherein the voltage across said electrodes is about 25–200 volts.

8. The method of claim 1 wherein the deposition is terminated when the deposited material reaches a thickness of about 1000 microns.

9. The method of claim 1 wherein the ceramic particles include particles selected from the group consisting of alumina, zirconia-toughened alumina, silicon nitride, titania, zirconia, and zirconium aluminum titanate.

10. The method of claim 9 wherein the ceramic particles include sintering aid particles.

11. The method of claim 1 wherein said piece has a density of at least about 50% of its theoretical density when removed from said cathode.

12. The method of claim 1 wherein said electrodes comprise a plurality of said cathodes and whereby a plurality of pieces is simultaneously deposited.

13. The method of claim 10 wherein the piece is sintered under pressureless sintering conditions.

14. The method of claim 1 wherein said piece is a cylindrical tubular piece and said densified part is an optical ferrule.

15. The method of claim 6 wherein the pH is maintained at about 1.5–2.0.

16. The method of claim 11 wherein the density is at least 60% of theoretical when removed.

17. The method of claim 14 wherein said tubular piece has multiple hollow portions.

18. The method of claim 1 wherein the anode is cylindrical and surrounds the cathode which is in the form of a wire.

* * * * *